United States Patent [19]

White et al.

[11] Patent Number: 4,777,066

[45] Date of Patent: Oct. 11, 1988

[54] GIFT BAG WITH DECORATIVE SELF-FORMING BOW

[76] Inventors: Ruth A. White, 550 Horton Ave., Tipp City, Ohio 45371; Gary A. McGee; Mary G. Nash, both of c/o Mary G. Nash & Associates, 40 High St., Hamilton, Ohio 45011

[21] Appl. No.: 890,198

[22] Filed: Jul. 24, 1986

Related U.S. Application Data

[63] Continuation-in-part of Ser. No. 772,810, Sep. 5, 1985, Pat. No. 4,608,283.

[51] Int. Cl.[4] ..... D04D 7/10

[52] U.S. Cl. ..... 428/4; 24/266; 156/70; 383/76; 428/101

[58] Field of Search ..... 428/4, 5, 101; 156/70; 24/266; 383/76

[56] References Cited

U.S. PATENT DOCUMENTS

| | | | |
|---|---|---|---|
| 2,841,905 | 7/1958 | Wanchek | 428/5 |
| 3,301,387 | 1/1967 | Erickson | 428/5 X |
| 3,632,464 | 1/1972 | Grikis | 428/4 |
| 3,637,455 | 1/1972 | Pearson et al. | 428/4 |
| 3,679,126 | 7/1972 | Lake | 428/131 X |
| 3,913,648 | 10/1975 | Sessler | 150/52 G X |
| 4,112,551 | 9/1978 | Sales | 428/4 X |
| 4,270,247 | 6/1981 | Freedom | 24/30.5 R |
| 4,276,031 | 6/1981 | Lueck | 434/260 |
| 4,329,382 | 5/1982 | Truskolaski et al. | 428/4 |
| 4,476,168 | 10/1984 | Aoyama | 428/4 |
| 4,515,837 | 5/1985 | Cheng | 428/4 |
| 4,547,237 | 10/1985 | Hendrickson | 156/70 |
| 4,608,283 | 8/1986 | White | 428/4 |

*Primary Examiner*—Henry F. Epstein

*Attorney, Agent, or Firm*—Biebel, French & Nauman

[57] ABSTRACT

A bag or gift package particularly adapted for use with a self-forming ribbon bow is formed with front and rear panels joined together along three marginal edges, including the two sides and the bottom, and open at the top. A sleeve is formed in surrounding relation to the top of the bag and spaced inwardly of the top, to define a passageway for the insertion of the operating ribbons of a self-forming ribbon bow. The encircling sleeve includes transversely extending strips of material which are welded along their marginal edges to leave a center portion free, thereby defining a sleeve-like opening. Access openings are provided through the sleeve in the front and the rear of the panel for the insertion and removal of the bow operator ribbons, and cutouts are formed in the sealed marginal edges to permit the ribbons to exit and re-enter the sleeve in making the turn about the edges of the bag.

6 Claims, 2 Drawing Sheets

70
72
80
55
60
20
52
56
76
60b
19
54
64
66
60a
65
63
50
12
75
7

GIFT BAG WITH DECORATIVE SELF-FORMING BOW

RELATED APPLICATION

This application is a continuation-in-part of Ser. No. 772,810 filed Sept. 5, 1985, now U.S. Pat. No. 4,608,283 issued Aug. 26, 1986 and is incorporated herein by reference.

BACKGROUND OF THE INVENTION

Self-forming ribbon-type bows for attachment to packages are known, as shown in a number of prior patents, including U. S. Pat. No. 4,276,031 issued June 30, 1981 to Lueck and U. S. Pat. No. 4,476,168 issued Oct. 9, 1984 to Aoyama. In the above-identified application Ser. No. 772,810 now U.S. Pat. No. 4,608,283 the employment of such self-forming ribbon bows in combination with bags are shown, in which the inside or operator members of the bow, which are withdrawn or pulled to form the convolutions of the bow, are elongated with respect to the outer ribbons, for the purpose of encircling the bag or package.

However, it is desirable in many instances to use conventional self-forming bows, made of ribbon material, in which the inside and outside ribbon members are the same length. This is the arrangement as shown in the Lueck and Aoyama patents, noted above, and is the manner in which such self-making or self-forming bow ribbons are marketed. However, there exists a need for a gift package, such as a bag, which has been especially adapted for use with such ribbon bows, to provide a bag and bow gift combination. Further, it may be desirable to provide such a gift bag package with an assortment of ready-to-make ribbon bows of various colors, for particular purposes or whims of the purchasers.

SUMMARY OF THE INVENTION

In the present invention, the gift-receiving bag is provided with an encircling sleeve formed about the neck of the bag and preferably spaced somewhat from the top of the bag. The invention is particularly adapted for use on plastic bags, but may also be used with bags made of other materials, such as paper or the like.

The preferred embodiment is a plastic bag which is formed with a front panel and a rear panel, which panels are connected or joined to each other along their side and bottom margins, and are open at the top to receive a gift, or the like therein. A ribbon-receiving sleeve encircles the bag and is formed with front and rear portions associated with the front and rear panels. Preferably, the sleeve includes a tranversely extending strip of plastic material which is heat welded to the front and rear panels along the respective upper and lower margins of the strip, so as to form a transversely elongated passageway with the respective panels. The sleeve portion on the front panel is formed with a central opening for receiving the ribbons therein, and similarly the sleeve portion associated with the rear panel is formed with a central opening to permit the operator ribbons of the ribbon bow to exit therefrom, so that the ribbons may be extracted or pulled through the rear opening, and cause a gathering of the neck of the bag as the ribbons are pulled. Since the marginal edges of the bag at the joined front and rear panels are normally sealed, it is desirable to form cutouts in these edges to permit the operator ribbons, on either side, to exit and then re-enter the sleeve, in making the turn about the edges of the bag. Preferably, the sleeve is spaced from the open top of the bag a distance which at least equals the width of the sleeve, so that the bag may be gathered both above and below the sleeve in a decorative and attractive manner. Further, while the dimensions of the sleeve along the depth of the bag are not critical, it is sufficient to provide a transverse passageway along the surfaces of the front and rear panels through which the operator ribbons of the bow may be easily inserted by a user when it is desired to attach the bow to the bag.

The present invention is specifically adapted to use self-forming ribbon bows of the type in which an outer pair of bow or petal-forming ribbons are joined together at spaced locations along their respective margins and caused to fold or convolute into a circular array of individual petals or bows when they are slid to one end of a pair of narrow inside operator ribbons. Since the inside ribbons are narrower than the outside ribbons and within the margins of the spaced connections for the outside ribbons, they are free to slide relative to the outside pair. Thus, when the inside ribbons are withdrawn by gripping the inside pair relative to the outside pair, the outside ribbons are caused to form themselves into the individual elements of a bow, as previously described, by folding at the spaced marginal points of attachment. Thereafter, the now exposed inside ribbons may be attached to the package by threading through the passageways formed by the sleeve.

It is accordingly an object of this invention to provide a bag which is particularly adapted to receive a ribbon bow with the operator ribbons of the ribbon bow threaded thereabout, to form an attractive gift package.

Another object of the invention is the provision of a bag, such as a plastic bag, having joined together front and back panels, in which a sleeve is integrally formed thereabout, such as by the heat sealing of a transversely encircling strip of plastic material to define a transverse ribbon-receiving passageway, preferably with cutouts formed in the vertical edges at the region of the sleeve to permit the passage of the ribbon from the front panel to the back panel.

These and other objects and advantages of the invention will be apparent from the following description, the accompanying drawings and the appended claims.

DESCRIPTION OF THE PREFERRED EMBODIMENT

Figure 1:
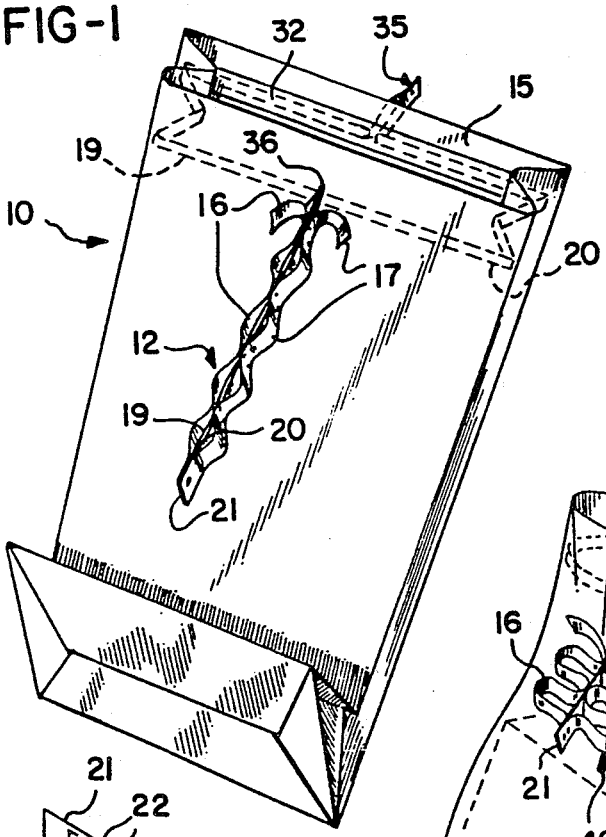
FIG. 1 is a perspective view of a gift package employing a ribbon bow.

A gift package is shown in FIG. 1 as including an open top bag 10 and a bow-forming ribbon member 12.

The bag 10 may be of any suitable material, such as decorative paper, plastic or the like, and may have any surface color or decoration applied thereto. An expandable open-top bag 10 is shown which is adapted to receive a gift therein and then drawn closed by gathering about its open top 15.

Figure 3:
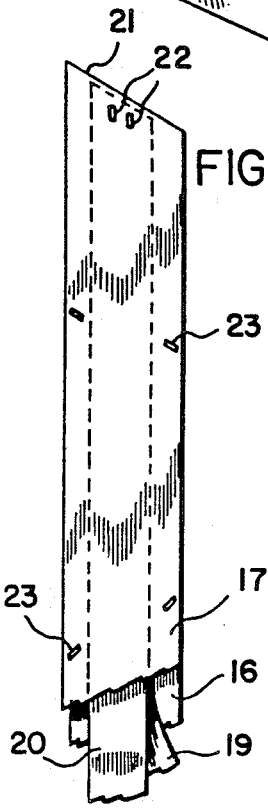
FIG. 3 is a fragmentary view of a bow-forming ribbon of the kind used in this invention.
Figure 4:
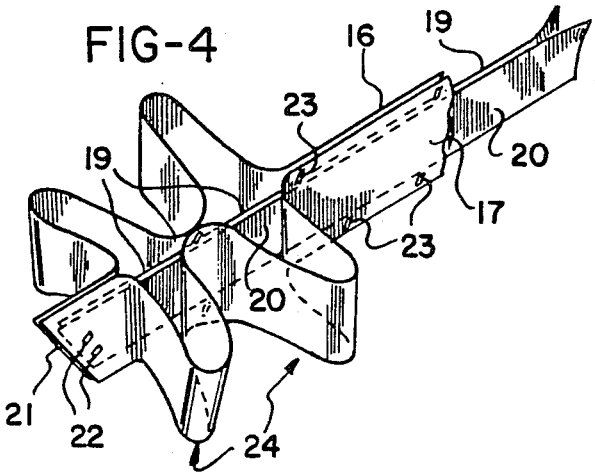
FIG. 4 is a perspective view showing the manner in which the bow elements of the outside ribbons form on the inside ribbons to form the bow.

The bow-forming or self-making ribbon-type bow member 12 is illustrated as having a pair of wider outside bow loop-forming ribbons 16 and 17 (FIGS. 3 and 4) and a pair of inside operating ribbons 19 and 20. The outer bow-forming ribbon pairs 16 and 17 are wider than the inside operating ribbon pairs 19 and 20, and normally extend from a common outer end 21 in sliding superimposed relation to the inside ribbon pair, as illustrated in FIGS. 3 and 4. All four ribbons are stapled or welded together in common at their common end as shown at 22 in FIGS. 3 and 4. Also, the outside pair is stapled or welded together at spaced locations along their marginal edges, such as by welds or pairs of fasteners 23. The fastened locations are at a bias or at an angle to the ribbons, as illustrated in FIG. 3, so that when the outer pair of bow-forming ribbons are caused to slide with respect to the inside pair of ribbons, the individual or convolutions 24 bow elements are formed.

Figure 2:
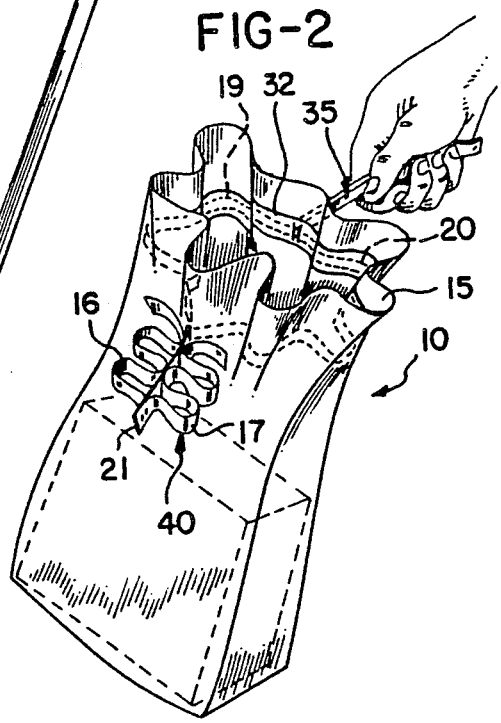
FIG. 2 shows the manner in which the package, with a gift enclosed, may be closed by pulling on the drawstring ribbons to form the bow.

The bow-forming ribbon 12 may be attached about the neck of a bag for closing the neck of the bag at the same time that the bow is formed. For this purpose, the inside ribbon pairs or operator ribbons 19 and 20 may be threaded through circumferentially spaced slots in the bag top or, as shown in FIG. 2, or may be threaded through a continuous inside sleeve member 32 which has been attached to or formed on an inside circumference of the bag, inwardly of the opening at the top. A forward portion of the wall of the bag is apertured at a forward slot or opening 36 through which the inside ribbons may be extended. The back wall is similarly formed with an aperture so that the remote ends of the ribbon may be gripped as shown at 35 in FIG. 2, and drawn away from the bag, to close the bag and to form the loops, as shown at 40 in FIG. 2, which make up the individual loops of the completed bow.

Figures 5, 6, 7:
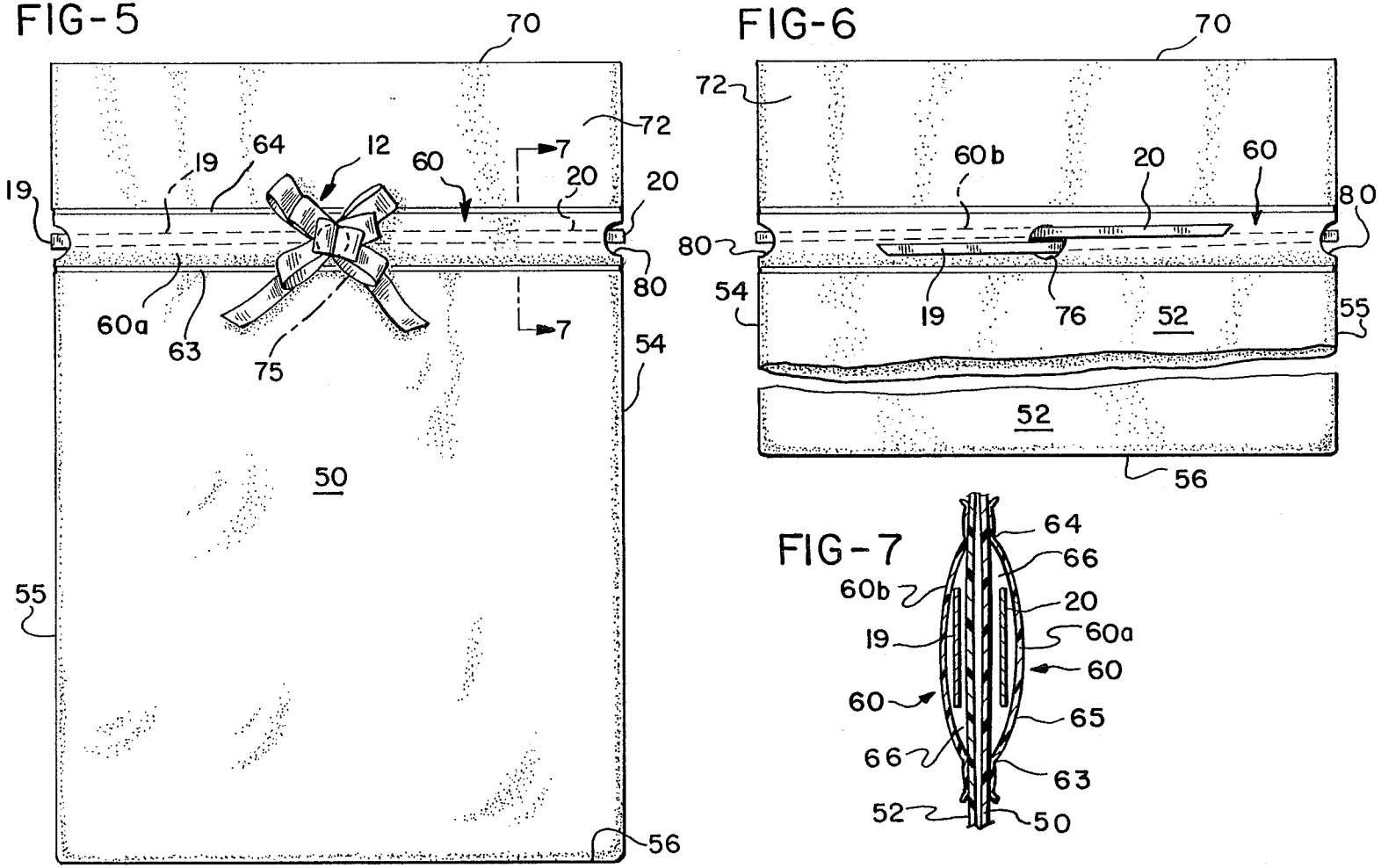
FIG. 5 is a plan view of a bag or package according to this invention.
FIG. 6 is a rear plan view of the bag of FIG. 5.
FIG. 7 is a vertical fragmentary section through the bag and sleeve taken generally along the line 7—7 of FIG. 5.

FIGS. 5–7 illustrate the preferred embodiment of a bag designed particularly for use with a self-forming bow as described above. The improved bag, which may be formed of a plastic film material, has a front panel 50 and a back panel 52 which are joined to each other along three marginal edges including the side edges 54 and 55 and the bag bottom 56. Means defining a sleeve 60 for receiving the operator ribbon members 19 and 20 of the ribbon bow 12 may include transversely positioned strips **60*a* (front) and 60*b* (back) of plastic film material similar to that comprising the front and back panels. The sleeve 60 is of narrow configuration, but is substantially wider than the operator ribbon members 19 and 20. The individual strips 60*a* and 60*b* making up the sleeve are positioned transversely of the bag respectively in juxtaposed relation across the respective front and back panels. The horizontal marginal edges 63 of the strips 60*a* and 60*b* are heat welded or otherwise bonded to the adjacent surface of the bag, leaving a center portion 65 free of attachment, thereby forming an interior passageway 66, as shown in the sectional view of FIG. 7. The sleeve is positioned inwardly of the top 70 of the bag around the neck of the bag at a distance at least equal to the width of one of the strips, so that a bag portion 72** extends above the sleeve formed by the strips, and thus provides material which will be gathered together in a pleasing and attractive manner when the bag is drawn closed.

The strip **60*a* extending across the front panel 50 is provided with a central opening or aperture shown in phantom at 75, while the rear strip 60*b* is also formed with a central opening or aperture as shown at 76 in FIG. 6. The front opening 75 permits the easy insertion of the ribbon members 19 and 20 therein, which then extend in opposite directions toward the marginal edges or sides of the bag. The sides or edges are cut out as shown at 80 to intercept and remove a small segment of the sealed edges of the panels and a small portion of the sleeve 60, to permit the ribbons to exit from the sleeve at the front panel 50** of the bag and re-enter into the sleeve at the rear of the panel.

The strips **60*a* and 60*b*** may be formed of the same material as that of the bag. They may be transparent if desired to show the ribbon therein, or may be made of a contrasting material from that of the bag itself.

In extracting the operator ribbon members 19 and 20 from a conventional bow-forming ribbon member 12, it will be necessary to gather the outer bow-forming ribbons 16 and 17 against the end 21 to form the bow, as shown in FIG. 5, thereby exposing and extending the operator ribbons 19 and 20 for ease of threading through the bag, as described above. Once these have been so extended and threaded into the sleeve through the front opening 75, and brought out the rear opening 76, it is only necessary to place the gift in the bag and then close the top of the bag by the gathering of the material accompanied by the further withdrawal of the ribbon members 19 and 20. These ribbon members may then be, if desired, be brought around and tied at the front, or tied together at the back, or tied and cut off, if desired.

While the improved bag adapted specifically for use with a bow-forming ribbon 12 has been described in relation to an external sleeve formed by the transverse strips **60*a* and 60*b*, it will be understood that these strips may be positioned along the opposed inside surfaces of the front and rear panels 50 and 52 to form an inside sleeve similar to that shown at 32 in FIG. 2**.

The cutout portions 80 permit the ribbon members 19 and 20 to be brought around the otherwise sealed marginal edges 54 and 55 of the bag by removing a small segment of the panels and at such edges. While the sleeve 60 may be formed continuously about the edges, it may be more convenient to remove a portion of the sleeve at the same time that the bag wall is removed, that is, after the heat sealing of the sleeve around the neck of the bag. In this case, the ribbon members are simply reinserted in sleeve portion at the back of the bag and into the passageway 66 as shown in FIG. 7 and the ends of the ribbon extended through the back opening 76.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a gift bag adapted to be closed with a decorative self-forming ribbon bow by the pulling of the bow operator ribbons about the neck of the bag, in which the bag is formed with a front panel which is joined along its marginal edges to a rear panel, the improvement comprising:

means defining a sleeve in generally encircling relation about the neck of the bag including a front portion on said front panel and a back portion on said back panel, means on said sleeve front portion defining an opening for receiving the operator ribbons of a self-forming bow therethrough, means on sleeve back portion defining an opening for the exit of said bow-forming ribbons therethrough, and means at said side marginal edges defining openings through said sleeve portions and through said panels, providing for the threading of said operator ribbons from said front sleeve portion to the said back sleeve portion.

2. The bag of claim 1 in which said sleeve is formed by transverse front and back strips joined respectively to said front and back panels along the longitudinal edges of said strips.

3. The bag of claim 2 in which said sleeve is spaced from the bag top a distance at least equal to the width of said strips.

4. The bag of claim 2 in which said bag panels and said strips are formed of plastic film material.

5. In a gift bag adapted to be closed with a decorative self-forming ribbon bow by the pulling of the bow operator ribbons about the neck of the bag, in which the bag is formed with a front panel and a rear panel, which panels are mutually joined to each other along opposite side edges thereof, the improvement comprising:

means defining a sleeve formed externally of said bag in generally encircling relation about the neck of the bag including a front strip portion on said front panel and a back strip portion on said back panel, means on said sleeve front strip portion defining an opening for receiving the operator ribbons of a self-forming bow therethrough, and means on sleeve back strip portion defining an opening for the exit of said bow-forming ribbons therethrough.

6. The bag of calim 5 in which said sleeve strip portions are joined to the respective said panels exclusively along longitudinal edges of said strip portions.

* * * * *